US005494768A

United States Patent [19]

Boswell et al.

[11] Patent Number: 5,494,768

[45] Date of Patent: Feb. 27, 1996

[54] TONER COMPOSITION CONTAINING ETHYLENE BISAMIDE COMPOUNDS

[75] Inventors: James Boswell, Nashua; Albert W. LeClair, Hudson, both of N.H.

[73] Assignee: Nashua Corporation, Nashua, N.H.

[21] Appl. No.: 333,245

[22] Filed: Nov. 1, 1994

Related U.S. Application Data

[63] Continuation of Ser. No. 955,298, Oct. 1, 1992, abandoned.

[51] Int. Cl.[6] ..... G03G 9/083; G03G 9/107

[52] U.S. Cl. ..... 430/106.6; 430/109; 430/110; 430/111; 430/137

[58] Field of Search ..... 430/106.6, 109, 430/110, 111, 137

[56] References Cited

U.S. PATENT DOCUMENTS

| | | | |
|---|---|---|---|
| 3,951,835 | 4/1976 | Tomono et al. | 252/62.1 |
| 4,212,966 | 7/1980 | McClain | 528/486 |
| 4,287,282 | 9/1981 | Miyakawa et al. | 430/107 |
| 4,314,017 | 2/1982 | Takahashi et al. | 430/109 |
| 4,395,485 | 7/1983 | Kashiwagi et al. | 430/903 |
| 4,401,741 | 8/1983 | Miyakawa et al. | 430/110 |
| 4,514,487 | 4/1985 | Kasuya et al. | 430/137 |
| 4,585,723 | 4/1986 | Kishi et al. | 430/106 |
| 4,702,989 | 10/1987 | Sugiyama et al. | 430/137 |
| 4,725,521 | 2/1988 | Shigeta et al. | 430/108 |
| 4,792,513 | 12/1988 | Gruber et al. | 430/110 |
| 4,795,689 | 1/1989 | Matsubara et al. | 430/99 |
| 4,853,361 | 8/1989 | Satake et al. | 503/201 |
| 4,859,558 | 8/1989 | Matsumura et al. | 430/110 |
| 4,904,762 | 2/1990 | Chang et al. | 430/110 |
| 4,963,457 | 10/1990 | Matsushita et al. | 430/138 |
| 4,988,598 | 1/1991 | Tomono et al. | 430/110 |
| 4,997,739 | 3/1991 | Tomono et al. | 430/110 |
| 5,045,423 | 9/1991 | Weber et al. | 430/110 |
| 5,077,169 | 12/1991 | Inoue et al. | 430/137 |
| 5,080,995 | 1/1992 | Fox et al. | 430/110 |
| 5,225,308 | 7/1993 | Sasaki et al. | 430/138 |

*Primary Examiner*—S. Rosasco
*Attorney, Agent, or Firm*—Testa, Hurwitz & Thibeault

[57] ABSTRACT

A toner composition is disclosed capable of developing electrostatically charged images formed on an electrophotographic member, comprising styrene-based resin particles, pigment particles, a charge-control agent and an ethylenebisamide compound. The toner has superior grinding, lubricating and anti-offset properties.

23 Claims, No Drawings

TONER COMPOSITION CONTAINING ETHYLENE BISAMIDE COMPOUNDS

This is a continuation of application Ser. No. 07/955,298 filed on Oct. 1, 1992, now abandoned.

BACKGROUND OF THE INVENTION

The present invention relates to toners for use in developing electrostatic images by dry development electrophotography, electrostatic printing and the like.

Dry development electrophotography utilizes finely divided dry toners or developers. Dry toners typically contain natural or synthetic resins having a coloring agent, such as carbon black, dispersed therein. Dry developers typically are two component systems which contain dry toners combined with magnetic carrier particles. Dry development processes include, for example, cascade, hair brushing, magnetic brushing, impression and powder cloud processes. All of these processes involve developing a formed electrostatic latent image using the toner.

After the image is developed by the toner, the image is "fixed." Fixation can be effected by melting the resin particles in the toner thereby fusing them together. Melt fixing can be accomplished by applying heat and/or a solvent to the toner image generally after the image has been transferred to sheet of paper. In the heat fixing method, heat is applied to the sheet of paper by means of heated fuser rollers. The heated fuser rollers apply both heat and pressure to the sheet, thereby permanently fixing the toner image onto the sheet. The surfaces of the fuser rollers are typically made from, or coated with, a non-stick material to prevent the toner from preferentially sticking to the surface of the rollers. Residue on the fuser rollers can be deposited on sheets which subsequently pass through the rollers, which results in poor image quality.

One method which has been used to prevent or minimize this problem is to coat the surface of the fuser roller with a non-stick material, such as a fluorocarbon resin and/or to apply a silicone oil to the roller so that a thin coating of the oil is maintained on the roller. This method suffers from several drawbacks: for example, the heat from the fuser rollers can cause odors to emanate from the liquid and/or the roller coating, and the use of an the silicone liquid requires a complex apparatus for metering the liquid to the rollers.

Another method which has been used to reduce sticking is adding a wax, such as paraffin or polyolefin wax, to the toner itself. In theory, the wax component should be sufficiently incompatible with the toner resin so that it does not mix with the tone resin. This is to ensure that when the paper imprinted with the toner image passes through the hot fuser rollers, the wax can rise to the surface of the toner thereby forming a waxy coating which prevents the toner from sticking to the rollers. However, paraffin waxes and polyolefin waxes (e.g., polyethylene or polypropylene) may adhere to the roller and/or paper surface, thereby reducing the quality of the image. In some toner compositions, the polyolefin wax is sufficiently compatible with the toner resin that it associates with the resin and does not tend to rise to the surface of the toner particles to prevent the toner from sticking to the fuser rollers. The result is the occurrence of offset and the resulting poor quality images.

It is an object of the present invention to provide a dry toner which is free of polyethylene, polypropylene or paraffin wax, and which does not require the use of oils or other liquids for use in developing electrostatic images.

SUMMARY OF THE INVENTION

The present invention provides magnetic and non-magnetic toners for use in electrophotography comprising a polymeric resin, magnetic particles or coloring agent, a charge control agent and an amount of an ethylenebisamide compound sufficient to provide lubricating and/or anti-offset properties to the toner.

In one aspect, the toner comprises a magnetic toner containing at least one styrene homopolymer or copolymer resin, magnetic particles, a charge control agent and an amount of the ethylenebisamide compound sufficient to provide the desired lubricity and anti-offset properties to the toner. In a particularly preferred embodiment, the toner comprises two or more styrene copolymer resins comprising styrene copolymerized with at least one acrylic co-monomer, magnetic particles, a charge control agent comprising an organic-metal coordination complex and an ethylenebisamide compound, preferably an ethylenebisfattyacidamide.

In another aspect, the toner comprises a non-magnetic toner containing at least one styrene homopolymer or copolymer resin, a coloring agent, a charge-control agent and a lubricating amount of the ethylenebisamide compound. The non-magnetic toner can be combined with magnetic carrier particles to form a developer if desired.

A method for reducing or preventing offset in a toner and increasing the lubricity of the toner by incorporating a lubricating, anti-offset amount of an ethylenebisamide compound into the toner is also the subject of the present invention. The method comprises blending the ethylenebisamide compound with the resin particles, the charge control agent and the pigment or the magnetic particles to form the toner. The ethylenebisamide compound aids in dispersing very small particles within the toner and prevents them from forming aggregates which can be deleterious to image quality when the toner is used. The presence of the bisamide compound provides a better dispersion, which results in a more uniform toner composition and, subsequently, better image quality. The amount of the ethylenebisamide compound added is an amount sufficient to impart the desired properties to the toner, which is generally at least 3.0 percent by weight of the toner composition.

The toner containing the ethylenebisamide compound as an internal additive provides excellent hot roller fixation properties and image quality. The present toners resist sticking to the fixing roller due to the presence of the ethylenebisamide on the surface of the toner particles. The present toner compositions produce superior development characteristics when used in developing electrostatic latent images.

DETAILED DESCRIPTION OF THE INVENTION

The toner compositions of the present invention generally comprise a polymer resin, a coloring agent or magnetic particles, a charge control agent and an amount of an ethylenebisamide compound sufficient to impart anti-offset and/or lubricating properties to the toner.

In one aspect, the invention comprises a magnetic toner comprising at least one styrene-acrylic resin, magnetic particles, a charge control agent and the ethylenebisamide compound. In another aspect, the invention comprises a non-magnetic toner comprising at least one styrene-acrylic resin, a coloring agent such as a pigment or dye, a charge control agent and the ethylenebisamide compound. The non-magnetic toner can be combined with magnetic carrier particles, for example, to form a developer. The present toners provide excellent image development and hot roller fixing properties without many of the drawbacks associated with toners containing paraffin or polyolefin waxes.

Magnetic toners of the present invention preferably comprise a styrene homopolymer or copolymer resin, magnetic particles, a charge control agent and an amount of an ethylenebisamide compound sufficient to provide lubricity to the toner and prevent its sticking to the fuser rollers. Non-magnetic toners of the present invention preferably comprise a styrene homopolymer or copolymer resin, a coloring agent, such as a pigment or dye, a charge control agent and an amount of an ethylenebisamide compound sufficient to provide lubricity and anti-offset properties to the toner composition. Post additives may be added to the toner compositions to improve particle flow, for example. Such post-additives include those known as useful in this technology, such as silica, alumina, titania, zirconia, magnesia, fine resin particles and/or metal salts of fatty acids.

A styrene polymer resin is preferably used as the resin component in the toner. The styrene polymer resin may be either a homopolymer of styrene or copolymer of styrene with other vinyl monomers. Vinyl type monomers which can be copolymerized with styrene to form a copolymer include p-chlorostyrene; vinyl naphthalene; ethylenically unsaturated monolefins such as, for example, ethylene, propylene, butylene and isobutylene; vinyl esters such as, for example, vinyl chloride, vinyl bromide, vinyl fluoride, vinyl acetate, vinyl propionate, vinyl benzoate and vinyl butyrate; esters of α-methylene aliphatic monocarboxylic acid such as, for example, methyl acrylate, ethyl acrylate, n-butyl acrylate, isobutyl acrylate, dodecyl acrylate, n-octyl acrylate, 2-chloroethyl acrylate, phenyl acrylate, methyl α-chloracrylate, methyl methacrylate, ethyl methacrylate, and butyl methacrylate, acrylonitrile, methacrylonitrile, acrylamide; vinyl ethers such as, for example, vinyl methyl ether, vinyl isobutyl ether and vinyl ethyl ether; vinyl ketones such as, for example, vinyl methyl ketones, vinyl hexyl ketone and methyl isopropenyl ketone; and N-vinyl compounds such as, for example, N-vinyl pyrrole, N-vinyl carbazole, N-vinyl indole and N-vinyl pyrrolidene. One or two or more of these monomers may be copolymerized with styrene monomer. Suitable styrene resins have an average molecular weight of at least about 3,000 or more and the styrene content of the resin is preferably at least about 25% by weight based on the total weight of the styrene type resin Styrene-acrylic copolymers in which styrene is copolymerized with one or more acrylic resins are particularly preferred. Acrylic monomers which are preferred co-monomers include, for example, acrylic acid, methacrylic acid, ethyl acrylate, ethylmethacrylate, butylacrylate, and butylmethacrylate.

Thermoplastic resins prepared by mixing a styrene-type resin with other resins may also be used as the resin component of the present toner. Other resins capable of being mixed with the styrene-type resin include homopolymers or copolymers of the following monomers: vinyl naphthalene; vinyl esters such as, for example, vinyl chloride, vinyl bromide, vinyl fluoride, vinyl acetate, vinyl propionate, vinyl benzoate and vinyl butyrate; esters of α-methylene aliphatic monocarboxylic acid such as, for example, methyl acrylate, ethyl acrylate, n-butyl acrylate, isobutyl acrylate, dodecyl acrylate, n-octyl acrylate, 2-chloroethyl acrylate, phenyl acrylate, methyl α-chloroacrylate, methyl methacrylate, ethyl methacrylate, and butyl methacrylate, acrylonitrile, methacrylonitrile, and acrylamide; vinyl ethers such as, for example, vinyl methyl ether, vinyl isobutyl ether and vinyl ethyl ether; vinyl ketones, such as, for example, vinyl methyl ketone, vinyl hexyl ketone and methyl isopropenyl ketone; and N-vinyl compounds, such as, for example, as N-vinyl pyrrole, N-vinyl carbazole, N-vinyl indole and N-vinyl pyrrolidone. Non-vinyl type thermoplastic resins also can be used such as, for example, resin-modified phenol formalin resins, oil-modified epoxy resins, polyurethane resins, cellulose resins and polyether resins. In the case where the above-mentioned resin is used in admixture with the styrene-type resin, both resins are preferably mixed with each other in such a manner that the styrene component comprises at least about 25% by weight based on the total weight of the resulting resin, preferably greater than 60% by weight.

The resin preferably comprises from about 30 to about 80% by weight of the toner. The resin most preferably comprises about 70% by weight of the toner. In a preferred embodiment, two different styrene-acrylate resins are blended; a resin comprising high molecular weight polymers and a resin or resin blend containing a range of low molecular weight to high molecular weight polymers. In a currently preferred embodiment of the present toner, a mixture of at least two styrene-acrylic copolymers is used, preferably a styrene-acrylate copolymer and a styrene butylacrylate copolymer. The styrene-acrylate copolymer resin preferably comprises a high molecular weight polymer, e.g., having a molecular weight of about 250,000 with a polydispersity of about 28. The styrene butylacrylate copolymer resin preferably comprises polymers having a range of molecular weight and having a molecular weight of about 500,000 with a polydispersity of about 2.4. The preferred ratio of styrene-acrylate resin to styrene-butylacrylate resin is from about 70:30 to about 50:50, most preferably 60:40.

The present magnetic toner contains magnetic material. The magnetic materials are those having magnetic properties or which can be magnetized, including ferromagnetic metals such as iron, cobalt, nickel and alloys or compounds of these metals. Preferred magnetic materials comprise fine particles of magnetic iron oxide, e.g., magnetite or hematite, most preferably having a particle size of about 0.1 to 2.0μ, more preferably about 0.1μ to 0.2μ. One or more kinds of these magnetic materials can be used in an amount of from about 10 to about 70 percent by weight of the toner composition, more preferably be in the range of about 20 to 50 percent by weight.

Any suitable pigments and/or dyes can be used in the present non-magnetic toner composition, which are compatible with the formulation. For example, pigments such as carbon black, lampblack, nigrosin dyes, aniline blue, calco oil blue, chrome yellow, ultramarine blue, DuPont oil red, quinoline yellow, methylene blue chloride, phalocyanine blue, malachite green oxalate, rose bengal, benzidine yellow, and mixtures of the above can be used. The amount included in the toner should be sufficient to impart the desired color and color intensity to the image formed from the toner. The amount of pigment added is preferably from about 6 to about 10 percent by weight.

A charge control agent is added to the present toner composition. The charge control agent is preferably selected to impart a negative charge to the toner resin. Negative charge-enhancing additives are well known in the art, and include materials such as, for example, orthohalophenylcarboxylic acids, metal complexes of salicylic acid, metal complexes of azo dyestuffs and pyridoxine aliphatic acid esters. Negative charge control agents which are particularly preferred for use in the present formulation are metal complexes of azo dyes, most preferably wherein the metal is chromium. In a currently preferred embodiment, the charge control agent used comprises chromate (1-),bis(1-((5-chloro-2-hydroxyphenyl)azo)-2-naphthalenolato(2-))-, hydrogen, which is available from Hodagaya Chemical Co., New York, N.Y. under the tradename T-95. The amount of charge control agent is preferably from about 1 to about 3 percent by weight of the toner formulation.

The present toner comprises an ethylenebisamide compound, or mixture of compounds. The ethylenebisamide compounds impart lubricity to the toner and prevent it from sticking to the hot fuser rollers during image fixing, for example. Ethylenebisamide compounds are a class of compounds having the general structure:

$$R-\overset{O}{\overset{\|}{C}}NCH_2CH_2N\overset{O}{\overset{\|}{C}}-R$$

wherein R is an organic alkyl or aryl radical having one or more carbon atoms. Ethylenebisamide compounds which are preferred for use in the present invention are those wherein R is a long chain aliphatic group having at least 10 carbon atoms. Most preferably, R is a saturated or unsaturated fatty acid. Fatty acid ethylenebisamides typically are produced by the reaction of two fatty acid molecules and one molecule of ethylenediamine. These compounds have many of the properties of neutral waxes, and have melting points in the range of about 120° to 145° C.

The ethylenebisamide compound which is currently most preferred is ethylenebisstearamide, the reaction product of stearic acid (a C-18 fatty acid) and ethylenediamine. Ethylenebisstearamide is available from Witco Corporation under the tradename Kemamide™. The amount of ethylenebisamide which is used in the toner should be an amount sufficient to provide the desired lubricating and/or anti-offset properties. From about 3 to about 5 percent by weight of the toner is sufficient for this purpose.

The present ethylenebisamide compounds are internal additives, that is, they are incorporated into the toner while it is being made. In this capacity, the ethylenebiasamide compounds aid in dispersing small magnetic or pigment particles in the toner composition, thereby providing a more uniform toner composition. For example, very small particles such as magnetic oxides and carbon blacks, are difficult to disperse, in part because they are difficult to "wet". That is, they have such a large surface area and high surface energy, that they are not easily coated with resins and/or liquids. This property makes these fine particles difficult to uniformly disperse in the toner formulation and therefore they tend to agglomerate. The presence of the agglomerates is detrimental to the quality of the image formed with the toner. This is particularly true where jet milling is used to manufacture the toner. The presence of the ethylenebisamide compound enhances the wetting and dispersibility of these fine particles, resulting in a more uniform toner composition with better reproducibility. The ethylenebisamide compounds are sufficiently incompatible with many toner resins, particularly styrene resins, that they do not tend to associate with the resins. The result of this incompatibility is that the bisamide compound will tend to rise to the surface of the toner particle when the particle is exposed to heat, e.g., at the fuser rollers, where it can exert its anti-stick properties. Another advantage is that these compounds are relatively low in molecular weight compared to polyolefin polymers or waxes, which enhances their ability to rise to the surface of the toner particles. Ethylenebisstearamide, for example, has a molecular weight of approximately 590 daltons.

Magnetic and non-magnetic toners of the present invention can be made by any art-recognized process. For example, the ingredients may be thoroughly mixed by blending, mixing and milling the components e.g., by ball-milling or extrusion, and thereafter pulverizing the components, e.g., by jet-milling to form particles having the desired size. Another well-known technique for forming toner particles is by spray-drying a ball-milled composition containing a colorant or magnetic particles, resin and a solvent. Toners containing an ethylenebisamide compound are improved dispersions due to the surface-active properties imparted by the ethylenebisamide. As stated above, ethylenebisamide compounds improve wetting of very small particles in the dispersion, thus permitting these particles to be more effectively dispersed and reducing the occurrence of agglomerates. The improvement in the dispersion or grinding properties is reflected in the end product in that a more uniform toner is obtained. Magnetic toners of the present invention preferably have an average particle size of from about 5μ to about 15μ, and more preferably have an average particle size of between about 10μ and 12μ.

Non-magnetic toners may include carrier particles to constitute a two-component type developer. Carriers which can be used include iron powders, ferrite powders and those coated with various resins, such as acrylic, pyrrolidone, or fluorinated polymer resins. Carrier particles comprising magnetic powders fixed with a binder can be used, if desired.

The present toner compositions provide excellent image density, charge stability and anti-offset properties, even after continuous and/or high speed copying.

The present invention is illustrated by the following examples, which are not intended to be limiting in any way.

EXAMPLES

EXAMPLE 1

A magnetic toner was prepared according to the following protocol:

| Ingredients | Percent by Weight |
|---|---|
| Styrene-acrylic resin | 36.0 |
| Styrene-butylacrylate resin | 25.0 |
| Magnetite particles | 33.5 |
| Charge control agent | 1.5 |
| Ethylenebisstearamide | 4.0 |

The styrene-acrylic resin (Hexatec HB04, Sekisui America Corp., New York, N.Y.) and styrene-butylacrylate resin (Hexatec H658-81) were preblended. The magnetite particles (Mobay PK5184, Miles, Inc., Pittsburg, Pa.), charge control agent (T-95, Hodogaya Chemical Co. (USA), Inc., New York, N.Y.) and ethlylenebisstearamide (Kemamide W40, Witco Corp., Oakland, N.J.) were dry blended and combined with the resin blend. The mixture was ground in a ball mill until all of the ingredients were combined. The resulting mixture was melt-blended by heating the mixture above the melting temperature of the resins, about 70° to 72° C., and stirring for about 10 to 20 minutes, until all of the ingredients were well blended. A uniform dispersion was obtained. The resulting dispersion was cooled and jet-milled to form toner particles having an average particle size of about 12μ and a median population size of about 8μ, with about 90% of the particles being larger than 5μ. Silica particles (1.0 pbw) and zinc stearate (0.1 pbw) were post-added to the toner composition.

Example 2

A magnetic toner was prepared as described in Example 1 but polyproplene (Viscol 550P, Sanyo Chemical Industries) was used in place of the ethylenebisstearamide.

Example 3

A magnetic toner was prepared as described in Example 1 but no wax component was used.

The fixing characteristics of toned images formed using toners of Examples 1, 2 and 3 were tested by subjecting the toners to continuous print testing in a Canon LBP-SX Laser printer for 3000 prints. The prints the amount of buildup on the fuser wand and the amount of fused toner on the backs of the sheets (offset) were evaluated by visual observation. The results are shown in Table 1.

TABLE 1

| Example No. | Image Of The 3000th Print | Buildup On Fuser Wand | Fused Toner On Back of Copies |
|---|---|---|---|
| 1 | Sharp | Slight | None |
| 2 | Sharp | Slight | None |
| 3 | Blurred | Heavy | Heavy Streaks |

Example 4

A non-magnetic toner was prepared from the following:

| Recipe Ingredients | Percent by Weight |
|---|---|
| Styrene-acrylic resin | 85.0 |
| Carbon Black | 10.0 |
| Charge Control Agent | 1.0 |
| Ethylenebisstearamide | 3.0 |

The toner was prepared according to the protocol set out in Example 1. The toner was milled to obtain particles having an average size of about 11.0μ. Silica particles (0.2 percent by weight) were post-added to the composition.

Example 5

A non-magnetic toner was prepared as described in Example 4 except that polyethylene (Polywax 2000, Petrolite Corp., St. Louis Mo.) was used in lieu of the bisstearamide.

Example 6

A non-magnetic toner was prepared as described in Example 4 but with no wax component.

The toners of Examples 4, 5 and 6 were run in a Mita 2055 copier for 20,000 copies and the fuser rolls were visually observed for toner buildup. The results are shown in Table 2.

TABLE 2

| Example No. | Condition Rubber Roll | Jamming In Fuser Section |
|---|---|---|
| 4 | Clean | No |
| 5 | Black Film | No |
| 6 | Heavy Black Film | Yes |

Equivalents

Those skilled in the art will be able to ascertain, using no more than routine experimentation, many equivalents to the specific embodiments described herein. Such equivalents are intended to be encompassed by the following claims.

We claim:

1. A magnetic toner composition for developing an electrostatic latent image on a photoreceptor, said toner comprising a uniform dispersion comprising:

a. a polymeric resin;

b. magnetic particles;

c. a charge control agent; and d. an ethylenebisamide compound having the structure:

$$R-\overset{O}{\overset{\|}{C}}NCH_2-CH_2N\overset{O}{\overset{\|}{C}}-R$$

wherein R is an alkyl or aryl group said ethylenebisamide compound being present at a concentration of from about 3.0 to about 5.0 percent by weight of the toner composition.

2. The toner composition of claim 1 wherein the ethylenebisamide compound comprises N,N-ethylenebisstearamide or N,N-ethyleneoleamide.

3. The toner composition of claim 1 wherein the magnetic particles comprise iron oxide particles.

4. The toner composition of claim 3 wherein the iron oxide particles comprise magnetite particles having a particle size of from about 0.1μ to about 2μ.

5. The toner composition of claim 1 wherein the charge control additive comprises a metal complex.

6. The toner composition of claim 5 wherein the metal comprises chromium.

7. The toner composition of claim 1 wherein the polymer comprises a styrene homopolymer or copolymer.

8. The toner composition of claim 7 wherein the resin comprises a blend of styrene-acrylic copolymers.

9. The toner composition of claim 1 comprising the following formula:

| Material | Percent by Weight |
|---|---|
| a. styrene-acrylic copolymer resin | 30 to 80 |
| b. magnetic particles | 10 to 70 |
| c. charge control agent | 1 to 3 |
| d. ethylenebisamide compound | 3 to 5. |

10. A magnetic toner composition comprising a uniform dispersion comprising:

a. a resin comprising a styrene homopolymer or styrene-acrylic copolymer b. magnetic particles;

c. a charge control agent; and d. an ethylenebisamide compound having the structure:

$$R-\overset{O}{\overset{\|}{C}}NCH_2-CH_2N\overset{O}{\overset{\|}{C}}-R$$

wherein R is an alkyl or aryl group, said ethylenebisamide compound being present at a concentration of from about 3.0 to about 5.0 percent by weight of the toner composition.

11. The magnetic toner of claim 10 wherein the resin comprises a blend of styrene-acrylic copolymers.

12. The magnetic toner of claim 10 wherein the magnetic particles comprise iron oxide.

13. The magnetic toner of claim 12 wherein the magnetic particles comprise magnetite particles having a particle size of from about 0.1μ to about 2μ.

14. A non-magnetic toner composition for developing an electrostatically charged image on a photoreceptor, said toner comprising a uniform dispersion comprising:

a. a polymeric resin;

b. a charge control agent;

c. a coloring control agent; and d. an ethylenebisamide compound. having the structure:

$$R-\overset{O}{\overset{\|}{C}}NCH_2-CH_2N\overset{O}{\overset{\|}{C}}-R$$

wherein R is an alkyl or aryl group, said ethylenebisamide compound being present at a concentration of from about 3.0 to about 5.0 percent by weight.

15. The non-magnetic toner composition of claim 14 further comprising carrier particles.

16. The non-magnetic toner composition of claim 14 wherein the resin comprises a styrene-acrylic copolymer or blend of styrene-acrylic copolymers.

17. The non-magnetic toner composition of claim 14 wherein the ethylenebisamide compound comprises N,N-ethylenebisstearamide or N,N-ethylenebisoleamide.

18. The non-magnetic toner composition of claim 14 wherein the coloring agent comprises carbon black.

19. A method for improving the lubricity and anti-offset properties of a toner comprising a uniform dispersion said method comprising incorporating into said uniform dispersion a lubricating, anti-offset amount of an ethylenebisamide compound in a polymeric resin, said ethylene bisamide compound having the structure:

$$R-\overset{O}{\overset{\|}{C}}NCH_2-CH_2N\overset{O}{\overset{\|}{C}}-R$$

wherein R is an alkyl or aryl group, said ethylenebisamide compound being present at a concentration of from about 3.0 to about 5.0 percent by weight.

20. The method of claim 19 wherein the toner comprises a magnetic toner.

21. The method of claim 19 wherein the toner comprises as non-magnetic toner.

22. The method of claim 19 wherein the ethylene bisamide compound comprises N,N-ethylenebisstearamide or N,N-ethylenebisoleamide.

23. A toner composition for developing an electrostatic latent image on a photoreceptor produced by the method comprising the steps of:

preparing a polymeric resin;

dry blending a charge control agent, and a ethylenebisamide compound with said polymeric resin into a mixture;

melt blending said mixture until a uniform dispersion is obtained;

cooling said dispersion; and milling said cooled uniform dispersion to form toner particles of a predetermined average size.

* * * * *